US005887387A

United States Patent [19]

Dallaire

[11] Patent Number: 5,887,387

[45] Date of Patent: Mar. 30, 1999

[54] DRAINAGE SYSTEM FOR HORIZONTALLY SLIDING CLOSURE ASSEMBLIES

[75] Inventor: Raymond Dallaire, Levis, Canada

[73] Assignee: Dallaire Industries Ltd., Levis, Canada

[21] Appl. No.: 774,085

[22] Filed: Dec. 23, 1996

[30] Foreign Application Priority Data

Dec. 27, 1995 [CA] Canada ..... 2166144

[51] Int. Cl.[6] ..... E06B 7/14; E06B 1/70

[52] U.S. Cl. ..... 49/408; 49/471

[58] Field of Search ..... 49/471, 408, 476.1; 52/235, 303, 302, 209; 454/196; 251/298; 13/527

[56] References Cited

U.S. PATENT DOCUMENTS

| | | | |
|---|---|---|---|
| 2,733,487 | 2/1956 | Hauck | 52/209 |
| 2,827,674 | 3/1958 | Hauck | 52/209 |
| 2,891,290 | 6/1959 | Hauck . | |
| 3,199,156 | 8/1965 | Riegelman | 52/209 |
| 3,314,201 | 4/1967 | Riegelman | 52/209 |
| 3,410,027 | 11/1968 | Bates | 52/209 |
| 3,503,169 | 3/1970 | Johnson et al. . | |
| 4,003,171 | 1/1977 | Mitchell | 52/209 |
| 4,154,033 | 5/1979 | Krueger et al. | 52/209 |
| 4,691,487 | 9/1987 | Kessler | 52/209 |
| 5,067,279 | 11/1991 | Hagemeyer | 49/471 |
| 5,123,212 | 6/1992 | Dallaire et al. | 58/209 |
| 5,341,600 | 8/1994 | Heppner | 49/471 |

FOREIGN PATENT DOCUMENTS

| | | |
|---|---|---|
| 1537347 | 12/1978 | United Kingdom . |
| 2155088 | 9/1985 | United Kingdom . |

*Primary Examiner*—Daniel P. Stodola
*Assistant Examiner*—Curtis Cohen
*Attorney, Agent, or Firm*—Rader, Fishman, Grauer and McGarry

[57] ABSTRACT

A drainage system for horizontally sliding closures, especially horizontally sliding closures having a solid sill such as is typical with patio doors and the like. The drainage system includes a valve assembly having a top wall, opposed end walls and a side wall that defines a drainage aperture. The drainage aperture is normally closed by a flap which permits water to drain through the valve assembly but inhibits the infiltration of outside air. The valve assembly is mounted over a drainage slot cut through the fixed rail. To ensure most efficient drainage performance, the fixed rail must be vented. This is preferably accomplished by replacing the usual end caps for the fixed rail with slotted end caps which maintain the internal air pressure in the fixed rail at substantially atmospheric pressure. The advantage is a simple, inexpensive very effective drainage system which is suitable for new product and the retrofit of installed doors and/or windows.

11 Claims, 4 Drawing Sheets

DRAINAGE SYSTEM FOR HORIZONTALLY SLIDING CLOSURE ASSEMBLIES

FIELD OF THE INVENTION

The present invention relates to horizontally sliding closure assemblies such as patio doors and, in particular, to a drainage system for evacuating water driven by wind or the like around the panels of horizontally sliding closure assemblies.

BACKGROUND OF THE INVENTION

The drainage of rain water and condensation from the sills of windows and patio doors has long been recognized as a problem in the door and window industry. The problem is particularly acute for patio doors because the sill structure generally does not permit much latitude in designing an effective drainage system. It is well known that the sills of all sliding closure assemblies require some form of drainage to prevent rain water and/or condensation from entering the interior of a building around the movable panes. Many drainage systems designed to solve this problem have been invented. Most such drainage systems, however, require a hollow sill construction and are not adapted to the drainage of horizontally sliding closure assemblies such as patio doors which are normally constructed with a solid sill for strength and durability. The infiltration of wind driven water is also a particular problem with patio doors because it is desirable to have a sill profile that is as low and unobtrusive as possible to facilitate passage through the door with wheelchairs and the like.

Canadian Patent Application No. 2,059,505 (Heppner laid open July, 1992) discloses a sliding door sill which appears to be an aluminum extrusion having a rail for slidably supporting a movable panel of the door and a rail for supporting a fixed panel on the sill. Positioned behind the rail that supports the fixed panel is a raised platform for supporting a pile weatherstrip which prevents air and dust infiltration around the slidable panel. Provided next to the fixed panel is a drainage groove. Drainage holes are cut through the rail for supporting the fixed panel and each drainage groove is scaled with a weep seal made of a flexible rubber, such as a silicone rubber. The weep seal is provided to seal the openings against air infiltration but to yield to water pressure when water accumulates in the drainage groove. It is not clear from the disclosure of this invention, but it appears that the weep seal extends along the entire bottom edge of the fixed panel.

U.S. Pat. No. 5,067,279 (Rolscreen Company, Nov. 26, 1991) describes a door threshold for an inwardly swinging door which comprises a two-part extrusion having an interior section and an exterior section. The interior section includes a plurality of drain holes intended to drain water entering past the door. Each drain hole is provided with a silicone rubber check valve which is designed to permit water to drain outwardly but to prevent air from infiltrating from the outside. The check valve is designed to open when enough water accumulates to provide adequate pressure to open the valve. Wind pressure is said to close the valve so that water is not blown inwardly across the sill. The valve is an elongated triangular shape which is mounted inside the threshold, thus requiring the two-part construction of the extruded threshold.

British Patent No. 1,537,347 (Clive Investments Pty. Limited, Dec. 29, 1978) relates to an extruded aluminum construction for door or window sills of the horizontally sliding type. The sill includes integral hinges on either side which support hinged flaps that are intended to permit water to drain from the sill while inhibiting the intrusion of air. The hinged flaps extend the full length of the inner and outer sides of the sill. It appears that in a normal condition, the flaps are spaced away from the sill and would permit air intrusion. Only with adequate air pressure would the flaps close against stops provided in the sill. Each side of the sill forms a support rail for a sliding panel. It is not disclosed how fixed panels are secured to the rail.

U.S. Pat. No. 4,003,171 (Mitchell, Jan. 18, 1977) describes a hydrostatic water discharge valve for an extruded aluminum window sill which is assembled from two or more extruded components. The hydrostatic discharge valve is positioned inside the sill to cover a drainage orifice through a partition in the sill. The valve includes a flap which is hingedly connected to the sill and a horizontal actuating vane which extends into the inner chamber of the sill below a weep opening. The actuating vane is designed to exert opening pressure on the discharge valve when water seeps through the weep opening and drips onto the actuating vane. This arrangement is useful only with two part hollow extrusions because the discharge valve has to be hingedly suspended from an inner partition of the window sill.

U.S. Pat. No. 3,845,599 (Comalco Limited, Nov. 5, 1974) discloses a drain valve assembly for an extruded two-part window sill which is designed to permit water to drain to an outside wall, to inhibit wind-blown water from migrating inwardly across the sill. The drain valve comprises a box-shaped structure having a partition wall which divides the structure into two chambers open at the top. A cylindrical float is positioned in the rear chamber under a drain opening, Water draining into the window sill enters the drain opening and flows over the float and the partition. In calm conditions, the water flows outwardly through a drain opening and an outer surface of the window sill. If high winds force water through the drain opening, the air pressure raises the water level in the float chamber and the float rises to block the drain opening, inhibiting water migration back across the sill. Again, this particular valve design can only be used in two-part hollow window sills since the sill must be in a disassembled condition in order to install the drain valve body.

It is an object of the present invention to provide a drainage system for horizontally sliding closure assemblies such as patio doors which permits the drainage of water from the interior of the closure and minimizes the ingress of air from an exterior of a building in which the sliding closure assembly is installed.

It is a further object of the present invention to provide a drainage system for horizontally sliding closure assemblies having solid sill constructions.

It is yet a further object of the present invention to provide a drainage system for horizontally sliding closure assemblies which is inexpensive to construct and simple to install.

It is another object of the invention to provide a drainage system for horizontally sliding closure assemblies which is adapted to be retrofitted to an installed horizontally sliding closure assembly.

SUMMARY OF THE INVENTION

In accordance with a first aspect of the invention, there is provided a valve assembly for the drainage of horizontally sliding closure assemblies which include a sill having a track for slidably supporting at least one horizontally slidable panel and a rail for supporting at least one fixed panel, the valve assembly comprising:

a substantially box-shaped hollow housing having at least a top wall, opposed end walls and a side wall that defines an aperture through which water may drain from the sill of the sliding closure assembly;

a flap mounted inside the valve assembly for closing the aperture, the flap being normally closed when the valve assembly is operatively mounted to the sliding closure; and means for mounting the valve assembly to the rail for supporting the at least one fixed panel;

whereby a drainage orifice is cut through the rail and the drainage orifice in the rail is enclosed by the valve assembly so that water may flow outwardly past the flap and through the drainage orifice while air is inhibited from flowing inwardly past the flap.

In accordance with another aspect of the invention there is provided a drainage system for a horizontally sliding window or patio door having an extruded rail for supporting at least one fixed window or patio door panel, the extruded rail being a hollow body with an inner wall face and an outer wall face, comprising:

a first drainage orifice in the inner wall face of the rail and a second drainage orifice in the outer wall face of the rail, the second drainage orifice being in fluid communication with the first drainage orifice;

a valve assembly mounted on the inner wall face of the rail and enclosing the first drainage orifice, the valve assembly comprising a housing having a top wall, a pair of opposed end walls and a side wall that defines an aperature through which water may drain and a flap and a flap movable between an open position to permit the passage of water through the first and second drainage orifices and a closed position to minimize the ingress of air through the first drainage orifice, the flap being in a normally closed position; and means for venting the rail, the means for venting being in fluid communication with the second drainage orifice such that atmospheric pressure is substantially maintained in the hollow body of the rail.

The present invention provides a simple, effective valve assembly for draining sliding closure assemblies such as patio doors, and a sliding closure assembly which is effectively drained using the valve assembly in accordance with the invention. The valve assembly is simply and inexpensively made and may be retrofitted to an installed sliding closure assembly without undue modification.

A sliding closure assembly fitted with a drainage system in accordance with the invention is effectively drained even in very adverse conditions, and also effectively inhibits the infiltration of outside air. It has been established through experimentation that a sliding closure assembly equipped with a drainage system in accordance with the present invention is at least about three times as resistant to the infiltration of wind blown water as the same sliding closure assembly without the drainage system.

DETAILED DESCRIPTION OF THE PREFERRED EMBODIMENTS

Figure 1A:
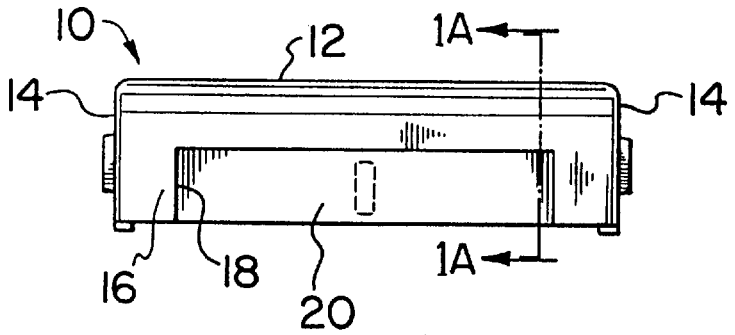
FIG. 1A is a rear elevational view of a valve assembly in accordance with the invention.
Figure 1B:
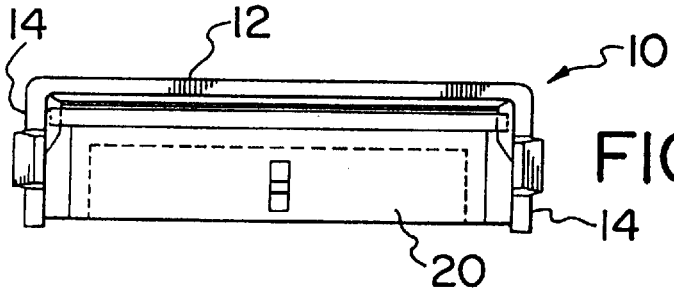
FIG. 1B is a front elevational view of the valve assembly shown in FIG. 1A.
Figure 1C:
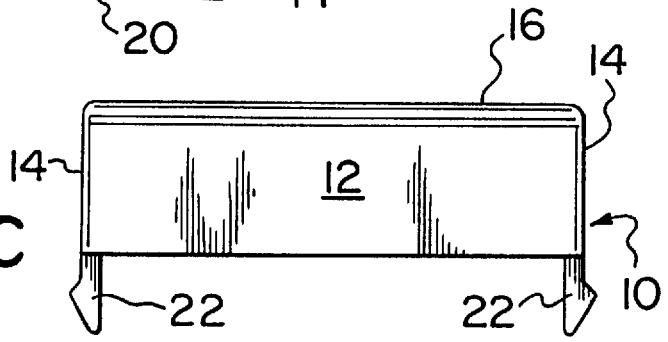
FIG. 1C is a top plan view of the valve assembly shown in FIG. 1A.
Figure 1D:
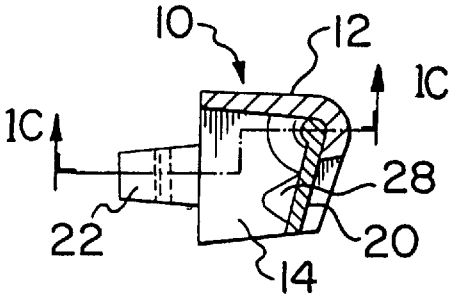
FIG. 1D is a cross-sectional view of the valve assembly taken along lines A—A of FIG. 1A.
Figure 1E:
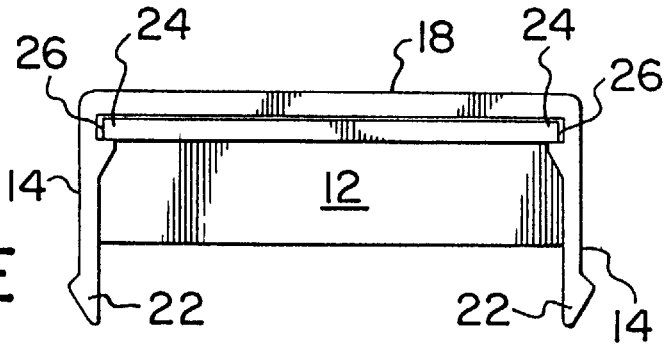
FIG. 1E is a horizontal cross-sectional view of the valve assembly taken along lines C—C of FIG. 1D.

As shown in FIGS. 1A–1E, a preferred embodiment of a valve assembly in accordance with the invention, generally indicated by the reference 10, is preferably a simple two-piece construction made from an injection molded plastics material. The valve assembly 10 includes a top wall 12, a pair of opposed end walls 14 and a side wall 16 which includes a drainage aperture 18 that is closed by a flap 20. The flap 20 is preferably hinged, as illustrated, but may likewise be a flexible resistant material that is affixed to a top of the drainage aperture 18 by an adhesive or a fastener. Attached to a front edge of the end walls 14 are locking tabs 22 used for attaching the valve assembly to a rail for supporting the fixed panel of the sliding closure assembly as will be explained in detail with relation to FIGS. 2 and 3. As described above, the flap 20 is preferably hingedly secured to a top edge of the end walls 14 as shown in FIGS. 1D and 1E. A top edge of the flap 20 includes hinge pins 24 which engage sockets 26 formed in the opposed end walls 14.

As shown in FIG. 1D, a bottom edge of the end walls 14 is preferably angled upwardly from the horizontal at an angle of approximately 5°. As is also appreciated from FIG. 1D, the side wall 16 is preferably angled inwardly from the horizontal at an angle of about 15°. This ensures that the flap 20 is returned to a closed position by the force of gravity. The flap 20 also includes a boss 28, preferably integrally molded to an inner surface of the center of the flap 20. The boss 28 prevents the flap 20 from making full contact with an inner surface of the top wall 12 where it could adhere to the top surface due to the surface tension of water droplets on the flap valve. This would cause the flap 20 to stick in an open position which is clearly undesirable. The size and shape of the boss 28 are not critical. It is only important that the inner surface of the flap 20 be spaced from the inner surface of the top wall 12 when the flap 20 is in a fully opened position.

A similar effect could be achieved if the boss 28 were located on the inner surface of the top wall 12.

Figure 2:
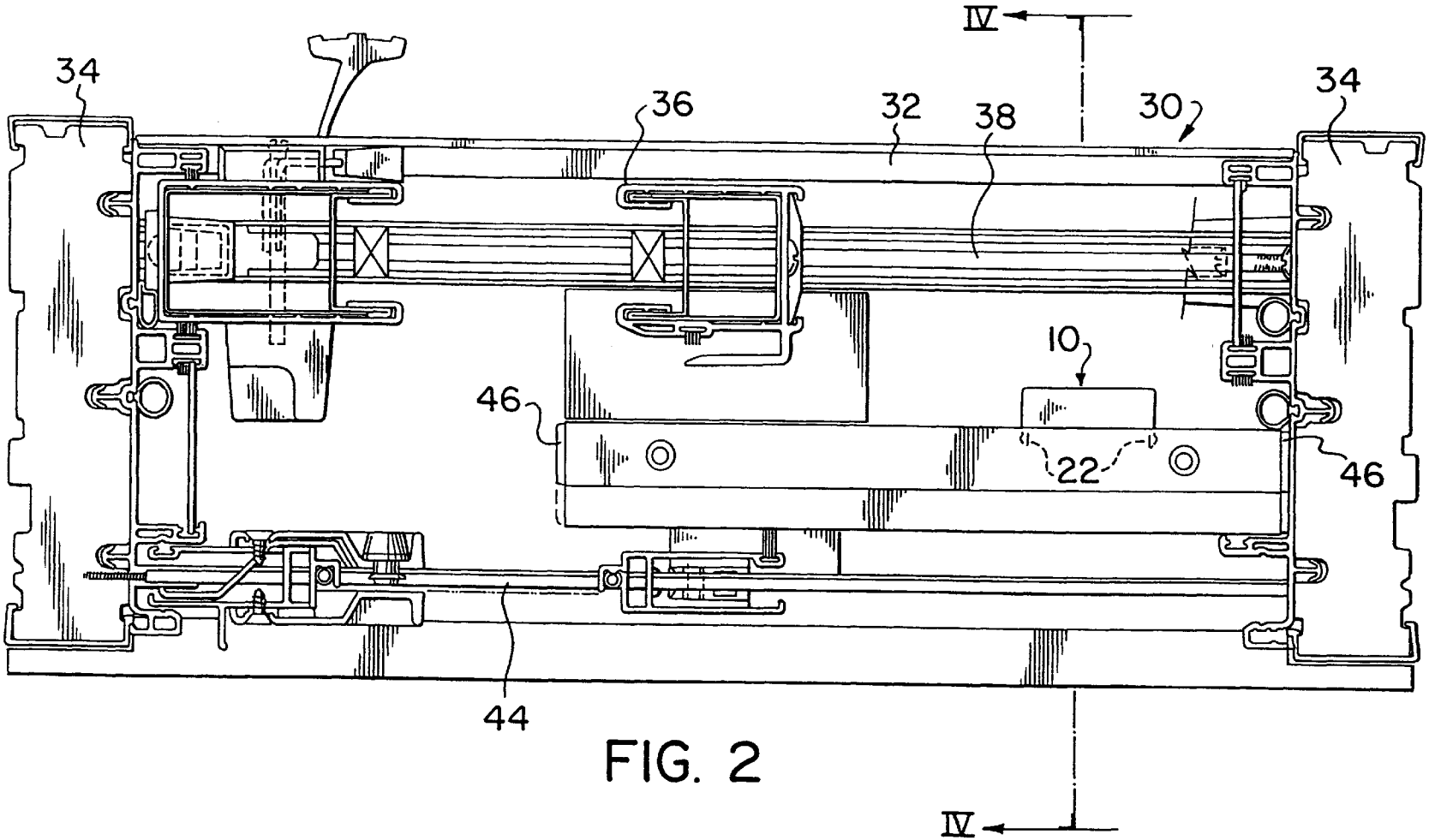
FIG. 2 is a horizontal cross-section of a patio door in accordance with the invention, the fixed panel of the door not being illustrated for the purpose of clarity.

FIG. 2 shows a horizontal cut through a patio door assembly 30 equipped with a drainage system in accordance with the invention. Patio door assemblies are well known in the art. They generally comprise a sill 32, opposed jambs 34, a sliding panel 36 supported on a track 38, a fixed panel 40 (see FIG. 3) which is supported by a fixed rail 42. The patio door 30 also generally includes a horizontally sliding screen door 44 well known in the art for excluding flying insects when the sliding panel 36 is open for ventilation.

In equipping the patio door assembly with a drainage system in accordance with the invention, the valve assembly 10 is attached to the fixed rail 42 which supports the fixed panel as will be described in more detail in relation to FIG. 4. The fixed rail is also further furnished with ventilating end caps 46 which replace the normal solid end caps for the hollow extrusion of the fixed rail 42. Each end cap 46 preferably includes a pair of slots to ensure that atmospheric pressure is maintained within the fixed rail 42. The slots are preferably about 1 cm (⅜") long by about 1 mm (0.080") wide. Experimentation has proven that in order to be most effective, the fixed rail 42 must be vented. Experimentation has also shown that the best results are obtained if the fixed rail 42 is vented using the end caps 46, as illustrated, though other venting arrangements may achieve the same results. The ventilating end caps 46 permit water to drain through the valve assembly 10 even under high wind conditions. The valve assembly 10 and the ventilating end caps 46 comprise the only components of the drainage system for sliding closure assemblies in accordance with the invention.

Figure 3:
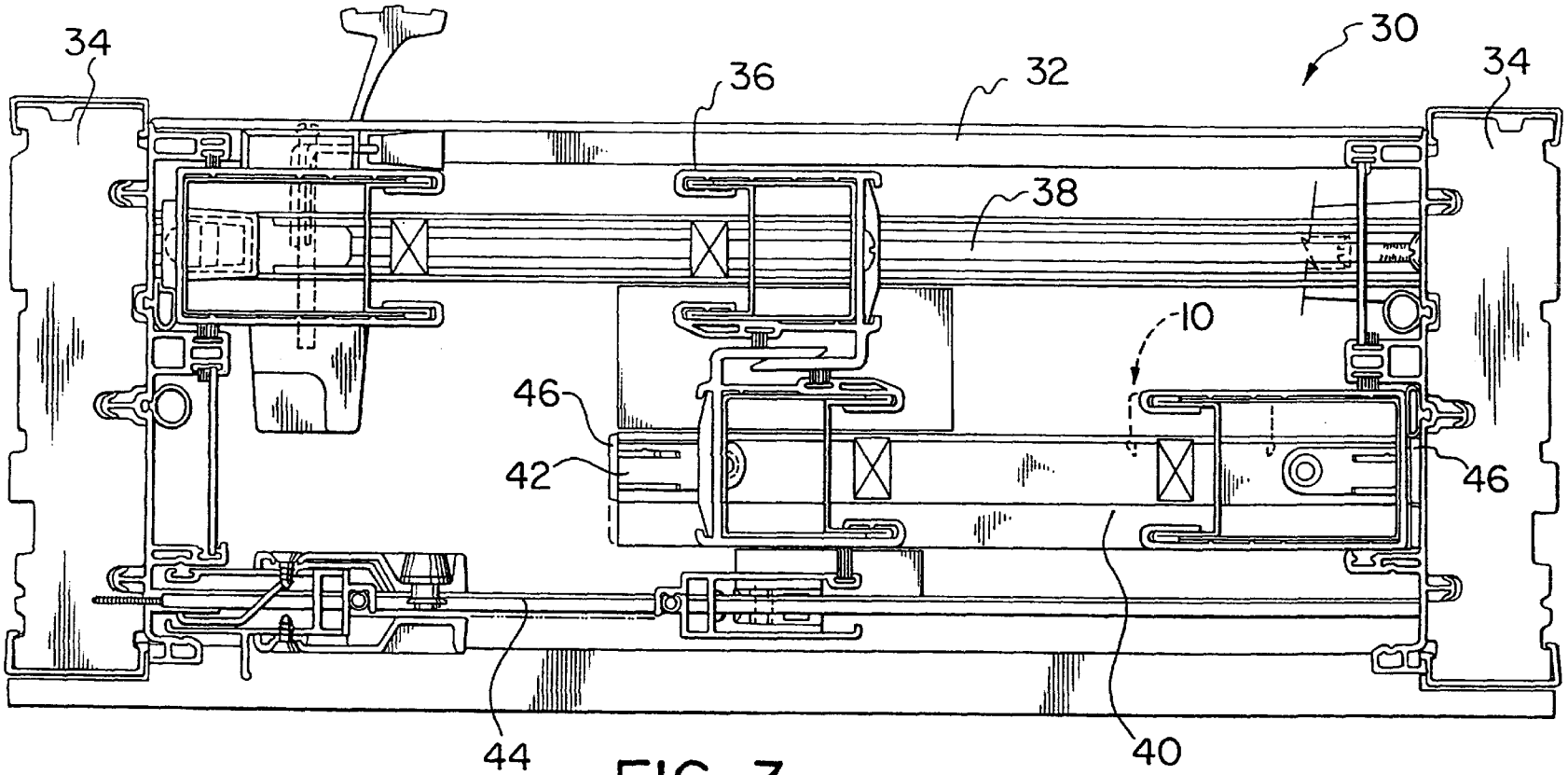
FIG. 3 is a horizontal cross-section of the patio door shown in FIG. 2, the fixed panel being shown in its normal position.

FIG. 3 shows a horizontal cross-sectional view of the patio door assembly 30 with the fixed panel 40 in its normal position. The construction of such door assemblies is well known in the art.

Figure 4:
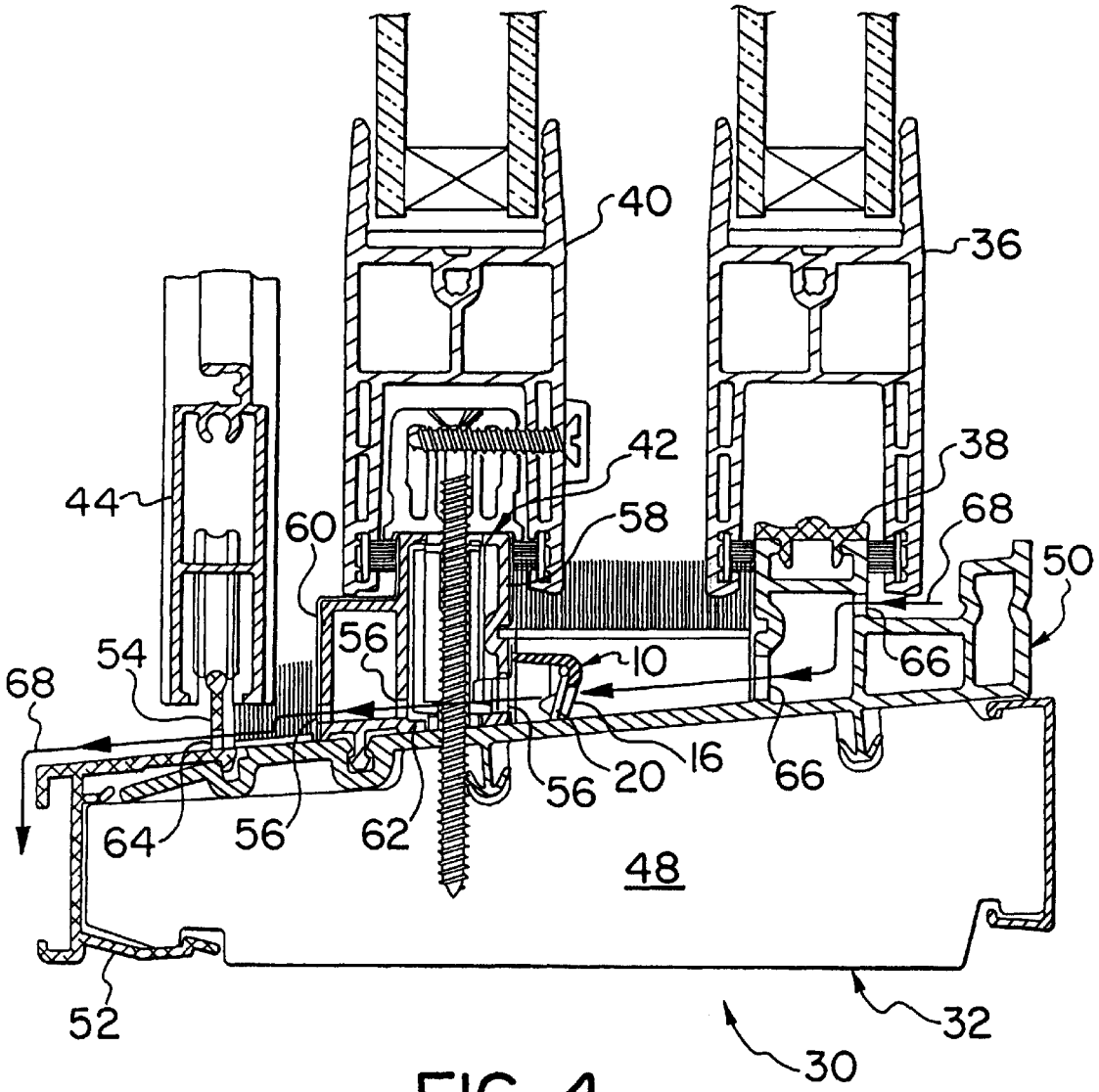
FIG. 4 is a vertical cross-section of the patio door taken along lines IV—IV of FIG. 2.

FIG. 4 shows a vertical cross-sectional view of the patio door assembly 30 taken along lines IV—IV of FIG. 2.

As explained above, the patio door assembly 30 includes a sill 32 which is generally a solid construction for durability. The sill 32 typically includes a wooden core 48 which is covered on a top surface by a sill plate 50, typically an extruded thermoplastic which may include an integral track 38 for supporting the sliding panel 36. A front edge of the core 48 is typically protected by an aluminum threshold 52 which generally includes an integral track 54 for slidably supporting the screen door 44. The fixed panel 40 is supported by a fixed rail 42 which comprises a hollow extrusion that may include one or more chambers as shown in FIG. 4. The fixed rail 42 has an inner wall face 58 and an outer wall face 60. In equipping the patio door assembly 30 with a drainage system in accordance with the invention drain orifices 56 are cut through the inner wall face 58 and the outer wall face 60 as well as through any intervening partitions in the fixed rail 42. The size and shape of these orifices is arbitrary but they are preferably rectangular slots about 35 mm long by 3.5 mm high. Cut in the inner wall face 58 on each end of the drainage aperture 56 is a narrow slot (not illustrated) for receiving the locking tabs 22 (see FIG. 2). To mount the valve assembly to the fixed rail 42, the locking tabs 22 are inserted in the slots (not shown) and the valve assembly 10 is pressed inwardly against the fixed rail 42. As the valve assembly 10 is moved towards the fixed rail 42, the locking tabs are deflected toward each other until they clear an inner surface of the inner wall face 58 of the fixed rail, at which time they rebound to lock the valve assembly 10 to the fixed rail 42.

As will be appreciated from FIG. 4, the angle of the bottom edge of the end walls 14 matches the angle of the sill plate 50. As is also appreciated, the angle of the side wall 16 urges the flap 20 to a closed condition. Experimentation has shown that the drainage system works best if the drainage apertures 56 are positioned above but immediately adjacent a bottom wall 62 of the fixed rail 42. This phenomenon is not clearly understood at this time, but experimental results support the fact that superior drainage is achieved if the bottom wall is left intact in the area where the drainage aperture 56 are located. Experimentation has also established that only one valve assembly 10 is required for each two-panel patio door assembly 30 although more than one valve assembly 10 may be installed. Doors having more than one fixed panel are also likely to require a valve assembly 10 for each fixed panel.

In order to complete the drainage system, drain apertures 64 are cut through the screen door track 54 at regular intervals. Typically, six to eight spaced-apart apertures of about 38 mm by 3 mm are cut in the base of the screen door track 54. In order to evacuate water which is blown past the sliding panel 36, drain apertures 66 are cut through the extrusion which supports the track 38 for the sliding panel 36. The drain apertures 66 are typically about 38 mm by 3 mm. The drain apertures 66, 56 and 64 provide a drain path schematically illustrated by the arrow 68 which evacuates water driven around the panels of the patio door assembly 30 by high winds and the like.

Preliminary experimental results are shown in Table 1 below.

TABLE 1

| | DOOR WITH PRIOR ART DRAINAGE | DOOR WITH DRAINAGE SYSTEM IN ACCORDANCE WITH INVENTION |
|---|---|---|
| Pressure before water migration over sill | 200 PA | 600 PA |
| Conditions before water migration over sill: | | |
| Wind velocity | 65.5 km/hr | 113.75 km/hr |
| Water quantity | 5 US gal./minute/sq. ft. | 5 US gal./minute/sq. ft. |

As is appreciated from the Table, preliminary tests show that water migrated over the sill of a door with prior art drainage at about 200 PA of pressure, which conditions were met at 5 US gal./minute/sq. ft. of door surface driven by simulated winds of 65.5 km/hr (40.7 mph). The door equipped with the drainage system in accordance with the invention did not leak water over the sill of the door until pressures exceeding 600 PA were created with 5 US gal./minute/sq. ft. of door area driven by simulated winds of 113.75 km/hr (70.5 mph). This demonstrates a significant improvement over the prior art. It has also been established that the drainage system in accordance with the invention reduces air infiltration from the exterior of a building in which the sliding closure assembly is installed.

INDUSTRIAL APPLICABILITY

The present invention provides a superior drainage system for horizontally sliding closure assemblies, especially horizontal sliding closure assemblies constructed with solid sills which permit limited freedom in designing drainage systems. Horizontal closure assemblies constructed in accordance with the invention are much more impervious to the infiltration of water because water blown past the panels of the closure is readily drained away without permitting the infiltration of outside air. The horizontal closure assemblies in accordance with the invention are therefore superior in that they are much more effective in preventing water damage to the interior of a building in which they are installed. Furthermore, the drainage system in accordance with the invention can be retrofitted to installed doors without undue difficulty. The drainage system in accordance with the invention also provides an economical solution to the problem of draining horizontally sliding closure assemblies.

While the invention has been described with reference to patio doors, it will be readily apparent to those skilled in the art that this drainage system can be applied to any horizontally sliding closure assembly and is not limited to any particular sliding closure assembly, including patio doors.

THE EMBODIMENTS OF THE INVENTION IN WHICH AN EXCLUSIVE PROPERTY OR PRIVILEGE IS CLAIMED ARE DEFINED AS FOLLOWS:

1. A drainage system for a horizontally sliding window or patio door, said system comprising:

an extruded rail for supporting one fixed window or patio door panel, the extruded rail being a hollow body with an inner wall face and an outer wall face and having a first drainage orifice in the inner wall face of the rail and a second drainage orifice in the outer wall face of the rail, the second drainage orifice being in fluid communication with the first drainage orifice;

a valve assembly mounted on the inner wall face of the rail and enclosing the first drainage orifice, the valve assembly comprising a substantially box-shaped hollow housing having at least a top wall, a pair of opposed end walls and a side wall that defines an aperture through which water may drain and a flap mounted inside the housing for opening or closing the aperture and movable between an open position to permit the passage of water through the first and second drainage orifices and a closed position in abutting relationship with said side to minimize the ingress of air through the first drainage orifice, the flap being in a normally closed position; and means for venting the hollow body of the rail to the atmosphere, the means for venting being in fluid communication with the second drainage orifice.

2. A drainage system as claimed in claim 1, wherein the flap is provided with means for abutting the top wall of the valve assembly when the flap is in a fully open position so that the flap does not directly contact an inner surface of the top wall to prevent the flap from being stuck in a fully opened position by the adhesive force of water trapped between the flap and the top wall.

3. A drainage system as claimed in claim 2, wherein the means for abutting is a boss on an inside face of the flap.

4. A drainage system as claimed in claim 1, wherein the side wall is inclined downwardly and inwardly of said housing to ensure that the flap is urged to a closed position.

5. A drainage system as claimed in claim 4, wherein the side wall is inclined at an angle of about 15 degrees from vertical.

6. A drainage system as claimed in claim 1, wherein the drainage orifice is a slot.

7. A drainage system as claimed in claim 1, wherein the drainage orifice is formed above a bottom wall of the rail.

8. A drainage system as claimed in claim 1, wherein the means for venting is a vented end cap in at least one end of the rail.

9. A drainage system as claimed in claim 1, wherein the valve assembly is provided with tabs for engaging complementary slots on opposite sides of the drainage orifice in the inner wall face of the rail.

10. A drainage system as claimed in claim 1, wherein the flap is hingedly mounted to be movable between the open and closed positions.

11. A drainage system as claimed in claim 10, wherein the flap is hingedly connected to the opposed end walls.

* * * * *

UNITED STATES PATENT AND TRADEMARK OFFICE
CERTIFICATE OF CORRECTION

PATENT NO.: 5,887,387

DATED: March 30, 1999

INVENTOR(S): RAYMOND DALLAIRE

It is certified that error appears in the above-identified patent and that said Letters Patent is hereby corrected as shown below:

Column 7, line 23, after "side" insert –wall--.

Signed and Sealed this

Fifth Day of October, 1999

*Attest:*

Q. TODD DICKINSON

*Attesting Officer*

*Acting Commissioner of Patents and Trademarks*